US005320544A

United States Patent [19]

Naoto et al.

[11] Patent Number: 5,320,544

[45] Date of Patent: Jun. 14, 1994

[54] MECHANISM FOR PREVENTING A LEVER TYPE CONNECTOR FROM BEING ERRONEOUSLY ACTUATED

[75] Inventors: Taguchi Naoto; Shinchi Akira, both of Shizuoka, Japan

[73] Assignee: Yazaki Corporation, Tokyo, Japan

[21] Appl. No.: 32,660

[22] Filed: Mar. 17, 1993

[30] Foreign Application Priority Data

Apr. 6, 1992 [JP] Japan ..... 4-83714

[51] Int. Cl.[5] ..... H01R 13/00

[52] U.S. Cl. ..... 439/157

[58] Field of Search ..... 439/152-160

[56] References Cited

U.S. PATENT DOCUMENTS

| | | | |
|---|---|---|---|
| 2,939,103 | 5/1960 | Agron et al. | 439/157 |
| 2,987,693 | 6/1961 | Wamsley | 439/157 |
| 3,488,622 | 1/1970 | Gley | 439/157 |
| 5,178,553 | 1/1993 | Hatagishi et al. | 439/157 |

*Primary Examiner*—Joseph H. McGlynn
*Attorney, Agent, or Firm*—Sughrue, Mion, Zinn, Macpeak & Seas

[57] ABSTRACT

Disclosure is a mechanism for preventing from a lever type connectro being erroneously actuated wherein each connector fitting operation can smoothly be achieved while preventing a cam lever from being erroneously turned, when a male connector is inserted into an female connector housing having the cam lever turnably supported thereon to assume a half fitted state. Sliding slots are formed on a pair of side walls of a female connector housing, while pins are projected outside of side walls of a male connector. A cam lever having eccentric cam grooves formed on the side wall surfaces thereof is turnably supported not only in the joint portion between adjacent female connector housings and but also on the outer side surfaces of the same to turn about a cam shaft, and both the female connector housings are jointed to each other via an actuating plate extending therebetween. A provisional engagement portion is formed on a side edge at the rear end of a horizontal groove portion of the eccentric cam groove, while an provisional engagement receiving portion is formed on the cylindrical surface of a pin projecting outside of the male connector at the position corresponding to the provisional engagement portion of the cam levers.

4 Claims, 5 Drawing Sheets

MECHANISM FOR PREVENTING A LEVER TYPE CONNECTOR FROM BEING ERRONEOUSLY ACTUATED

BACKGROUND OF THE INVENTION

The present invention relates generally to a lever type connector usable for connecting wire harnesses to each other or connecting a wire harness to an electric device or instrument with a low insertion force.

FIG. 8 is a perspective view of a conventional lever type connector a.

Referring to FIG. 8, the lever type connector a is constructed in such a manner that an upper wall d and a lower wall e of a female connector housings, c, c' and c'' having a plurality of terminals b arranged thereon extend in the direction intersecting the inserting/drawing direction of a male connector g at a right angle. The female connector housings c, c' and c'' are located adjacent to each other with a hollow space therebetween so as to permit a cam lever f, which is to be described later, to be inserted into the hollow space and retracted from the same. Male connectors g, g' and g'' are arranged corresponding to the female connector housings c, c' and c'', respectively.

A pair of sliding slots k are formed in the central portion of side walls h of the female connector housing c for guiding pins j' and j'' projecting from side walls j of the male connector g.

The cam lever f, of which one end is connected to an actuating plate m, is rotatably supported not only in a joint portion between adjacent female connector housings c, c' and c'' but also on the opposite outer side surfaces of each female connector housing to rotate about a cam shaft n extending along rear edge of the upper wall d. In addition, eccentric cam grooves p are formed in the cam lever f. The eccentric cam grooves are confronted with side wall surfaces of the female connector housings c, c' and c'' to serve as sliding means for slidably displacing the pins j' on the male connector g along the eccentric cam groove p.

While the cam lever f is held in the initial state, it is resiliently biased by springs (not shown) to assume the position where an actuating plate m of the cam lever f stands upright.

In the drawing, reference character q designates a base board to which leads b' extending from the terminals b are connected.

With the conventional lever type connector a constructed in the above-described manner, the male connector g is fitted into the female connector housing c while the pins j' on the male connector g are inserted into the sliding slots k and the eccentric cam grooves p which positionally overlap each other.

When each pin j' reaches the position where it abuts against a side wall p' located in the vicinity of an opening portion of the eccentric cam groove p, a provisional engagement projection r, protruding from the bottom wall of the male connector g, is received in a groove s formed on the inner wall surface of the female connector housing c beyond a stepped part t of the groove s, whereby the foregoing position is sensed by an operator who subsequently stops further insertion of the male connector g so as to hold it in a half fitted state (see FIG. 9(A).

Similarly, the other male connectors g' and g'' are inserted into the female connector housings c' and c'', and thereafter, the actuating plate m of the cam lever f is rotated in the direction of arrow F.

As the cam lever f is rotated in that way, the eccentric cam groove p slidably moves along the pin j' which in turn is displaced in such a direction that the male connector g is deeply inserted into the female connector housing c. Finally, the male connectors g, g' and g'' are fully inserted into the female connector housings c, c' and c'' to reach the completely fitted positions as shown in FIG. 9(C).

However, with the conventional lever type connector, there sometimes arises a malfunction in that the cam lever f is erroneously rotated in the F arrow-marked direction to assume the state as represented by solid lines in FIG. 9(B) when the pin j' on the first male connector g collides against the side wall p' located in the vicinity of the opening portion of the eccentric cam groove p on the cam lever f with an excessively large magnitude of inserting force while the first male connector g is held in the female connector housing c in the half fitted state.

At this time, since the opening portion of the eccentric cam groove p on the cam lever f is positionally offset downward of its correct position, there arises another malfunction that when the next male connector g' is inserted into the female connector housing c', the opening portion of the eccentric groove p can not be displaced to the position located corresponding to the pin j' on the next male connector g' unless the cam lever f is rotated in the F' arrow-marked direction with an operator's hand until it is retracted to the initial state represented by two-dot chain lines shown in FIG. 9(*b*). Consequently, each connector fitting operation is achieved at a low efficiency because of the aforementioned problems.

SUMMARY OF THE INVENTION

In view of the forgoing, an object of the present invention is to provide a mechanism for preventing a lever type connector usable for connecting wire harnesses to each other or connecting a wire harness to an electric device or instrument with a low intensity of inserting/drawing force from being erroneously actuated wherein once a male connector is inserted into a female connector housing to assume a half fitted state, a connector fitting operation can smoothly be achieved while preventing a cam lever from being erroneously turned.

To accomplish the above object, the present invention provides a mechanism for preventing a lever type connector from being erroneously actuated wherein a plurality of male connectors are fitted into a plurality of female connector housings successively jointed to each other to build an integral female connector housing assembly, pins are projected outside of the opposite side walls of each male connector, sliding slots are formed on the opposite side walls of the male connector so as to permit the pins to be displaced in the forward/rearward direction, a cam lever is turnably supported not only in the joint portions between adjacent female connector housings but also on the opposite side wall surfaces of the female connector housing assembly to turn about a cam shaft with the aid of an actuating plate extending across the female connector housing assembly, and eccentric cam grooves are formed on the side surfaces of the cam lever at the positions located corresponding to the pins so as to allow the cam grooves to slidably move along the pins until the male connectors are fully fitted into the female connector housings or disconnected from the same, wherein provisional engagement portions are disposed at the positions where pins on each male connector start to be inserted into eccentric cam grooves on the cam lever on the female connector housing side, and provisional engagement receiving portions are formed on the pins projecting outside of the male connector.

According to a first aspect of the present invention, the provisional engagement portion contoured in the form of an engagement projection is formed at the side surface located in the vicinity of an opening portion of an eccentric cam groove formed on the cam lever, and the provisional engagement receiving portion contoured in the form of an engagement recess is formed on the cylindrical surface of a pin projection outside of a male connector which is to be inserted into the female connector housing. Thus, while the male connector is held in the female connector housing in the half fitted state, the provisional projection disposed in the vicinity of the eccentric cam groove on the cam lever is temporarily engaged with the provisional engagement portion on the pin, causing the cam lever to be held in the provisionally engaged state. Consequently, there is no possibility that the cam lever is erroneously turned with an operator's hand.

According to a second aspect of the present invention, the provisional engagement portion contoured in the form of an engagement projection is formed on the bottom surface of the opening portion of the eccentric cam groove on the cam lever, and the provisional engagement receiving portion contoured in the form of an engagement projection is formed on the cylindrical surface of a pin projecting outside of a male connector which is to be inserted into the female connector housing. Thus, while the male connector is held in the female connector housing in the half fitted state, the provisional engagement portion formed in the eccentric cam groove on the cam lever is temporarily engaged with the provisional engagement receiving portion on the pin projecting outside of the male connector, causing the cam lever to be held in the provisionally engaged state. Consequently, there is no possibility that the cam lever is erroneously turned with an operator's hand.

DETAILED DESCRIPTION OF THE PREFERRED EMBODIMENTS

Figure 1:
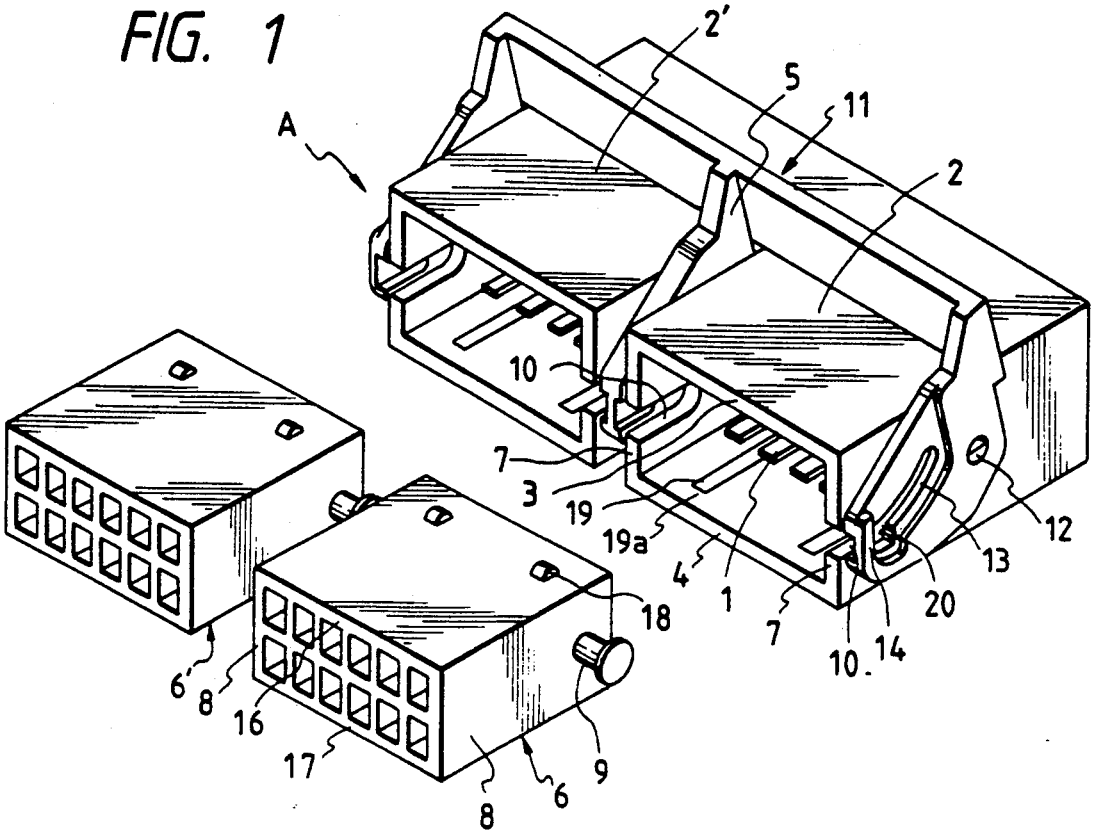
FIG. 1 is a perspective view of a mechanism for preventing a lever type connector from being erroneously actuated according to a first embodiment of the present invention.
Figure 2:
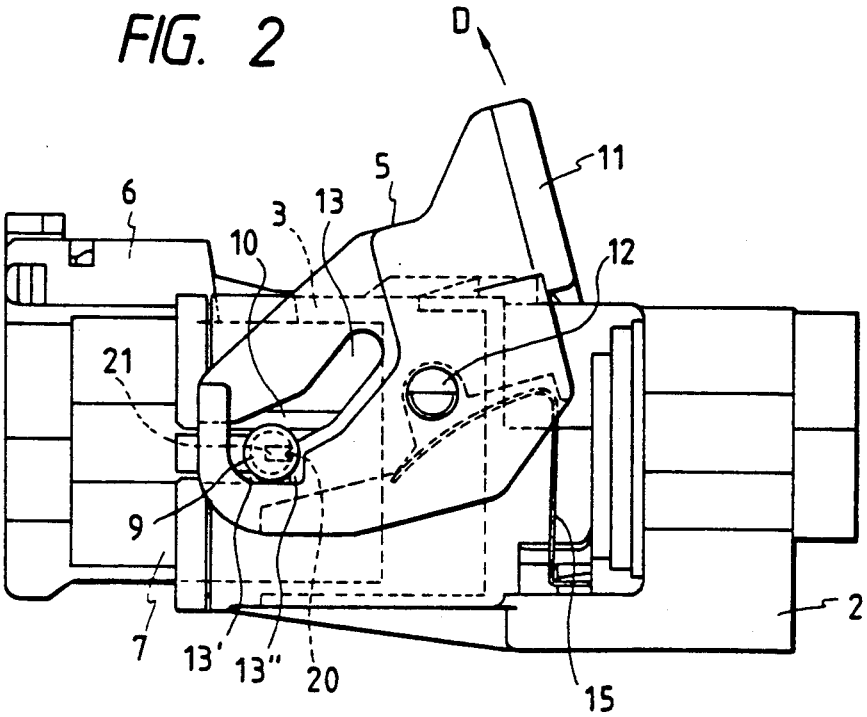
FIG. 2 is a side view of the mechanism shown in FIG. 1, particularly showing that a male connector is inserted into a female connector housing to assume a half fitted state.

FIG. 1 is a perspective view of a lever type connector A including a mechanism for preventing the connector A from being erroneously actuated wherein the mechanism is constructed according to a first embodiment of the present invention. FIG. 2 is a side view of the mechanism shown in FIG. 1, particularly showing the operative state where a male connector is partially fitted into a female connector housing to assume a half fitted state.

Referring to FIG. 1, an upper wall 3 and a lower wall 4 of a female connector housing 2 extend in the direction intersecting the inserting/drawing direction of male connectors 6 and 6' at a right angle, and the female connector housing 2 is connected to an adjacent female connector housing 2' via the upper wall 3 and the lower wall 4 while a wide space sufficient enough to allow a cam lever 5, to be described later, to rotate in the projecting/retracting direction is maintained therebetween, whereby an integral connector structure is constructed by the female connector housings 2 and 2' in cooperation with a pair of male connectors 6 and 6'.

A pair of sliding slots 10, serving as guiding means for a pair of pins 9 each having an enlarged head portion 9' projecting outside of a pair of side walls 6, are formed at the substantially central parts of the side walls 7 of the female connector housing 2 in the inserting/drawing direction of the male connectors 6.

A cam lever 5 having an actuating plate 11 integrated therewith at the right-hand end thereof is rotatably supported not only in the joint portion between the adjacent female connector housings 2 and 2' but also on the opposite side walls 7 of the latter to rotate about a cam shaft 12 projecting outwardly of both the side walls 7 of the female connector housing 2 and 2'. An eccentric cam groove 13, of which a bottom part is partially cut out while exposing to the side surface of each of the female connector housings 2 and 2', is formed on the cam lever 5. Thus, the eccentric cam groove 13 constitutes sliding means for slidably displacing the pin 9 on the male connector 6 along the eccentric cam groove 13. It should be noted that a bottom plate 14 is bridged across the opening portion of the eccentric cam groove 13 so as to enable the head portion 9' of the pin 9 projecting outside of the male connector 6 to pass past the bottom plate 14.

While the cam lever 5 is held in the initial state, it is resiliently biased by a leaf spring 15 (see FIG. 2) so that the actuating plate 11 of the cam lever 5 assumes an upright standing attitude.

It should be noted that provisional engagement projections 18 formed on the outer surfaces of an upper wall 16 and a lower wall 17 of the male connector 6 serve to constitute provisional engaging means in cooperation with grooves 19 formed on the inner surfaces of the upper wall 3 and the lower wall 4 of the female connector housing 2 when the male connector 6 is fitted into the female connector housing 2.

Figure 3:
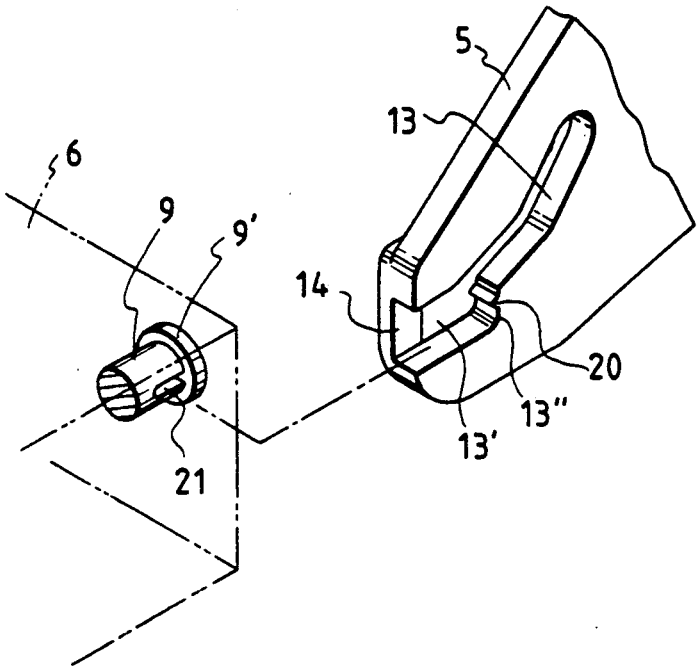
FIG. 3 is a fragmentary perspective view of the mechanism, particularly showing essential components for the mechanism in the disassembled state.

As shown in FIG. 2, a provisional engagement portion 20 contoured in the form of an engagement projection is formed on upright standing side edge 13'' of the eccentric cam groove 13 at the rear end of a horizontal groove portion 13' of the eccentric cam groove 13 on the cam lever 5, and a provisional engagement portion 21 contoured in the form of an engagement recess is formed on the fore side surface of the pin 9 projected outside of the male connector 6 corresponding to the provisional engagement portion 20 of the cam lever 5 (see FIG. 3).

Since the mechanism for preventing a lever type connector from being erroneously actuated is constructed according to the first embodiment of the present invention in the above-described manner, when the male connector 6 is inserted into the female connector housing 2, i.e., in practical use, the horizontal groove portion 13' extending from the opening portion of the eccentric cam groove 13 on the cam lever 5 positionally overlaps the sliding slot of the connector housing 2 due to the actuating plate 11 of the cam lever being normally resiliently biased by the leaf spring 15, as mentioned above, to assume the position where it intersects the female connector housing 2 at a right angle. Thus, the horizontal groove portion 13' is ready to receive the pin 9 on the male connector 6.

As the male connector 6 is inserted into the female connector housing 2, the pin 9 on the male connector 6 moves past the opening portion of the eccentric cam groove 13 to reach the position where it abuts against the upright standing side edge 13'' of the eccentric cam groove 13 located at the rear end of the horizontal groove portion 13'. At the same time, the provisional engagement projections 18 on the outer surface of the male connector 6 are received in the grooves 19 across stepped parts 19*a* to reach the foregoing position. This is sensed by an operator, and subsequently, he stops further insertion of the male connector 6, resulting in the male connector 6 and the female connecter housing 7 being held in a half fitted state.

Figure 4:
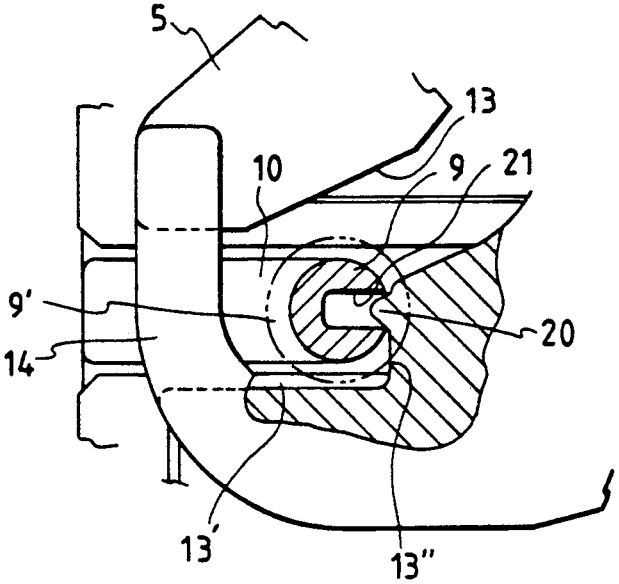
FIG. 4 is a fragmentary vertical sectional view of the mechanism, particularly showing that components for the mechanism are held in the half fitted state.

At this time, the provisional engagement portion 21 on the pin 9 is engaged with the provisional engagement receiving portion 20 on the horizontal groove portion 13' of the eccentric cam groove 13 to assume a provisionally engaged state. Thus, the cam lever 5 can be held in the initial state further unless a large magnitude of turning force in excess of a predetermined value is imparted to the cam lever 5 (see FIG. 4).

When the cam lever 5 is turned in the D arrow-marked direction in FIG. 2 after the male connector 6' is inserted into the female connector housing 2' to assume a half fitted state in the same manner as mentioned above, the provisionally engaged state, where the provisional engagement portion 20 on the horizontal groove 13' is brought into provisional engagement with the provisional engagement receiving portion 21 on the pin 9, is canceled when the magnitude of turning force imparted to the cam lever 5 exceeds a predetermined value. Subsequently, the eccentric cam grooves 13 slidably move along the pins 9 on the male connector 6 and 6' in such a direction that the pins 9 moves along the eccentric cam grooves 13 further in the fitting direction, whereby the male connectors 6 and 6' are fully fitted into the female connector housings 2 and 2'.

With this construction, once the first male connector 6 is inserted into the female connector housing 2 to assume the provisionally engaged state in the above-described manner, there is no possibility that the cam lever 5 is erroneously actuated. Thus, when the next male connector 6' is inserted into the female connector housing 2', there does not arise a necessity for the operator to return the cam lever 5 to the initial state every time each male connector is inserted into a female connector housing, resulting in each connector fitting operation being achieved at a high efficiency.

Figure 5:
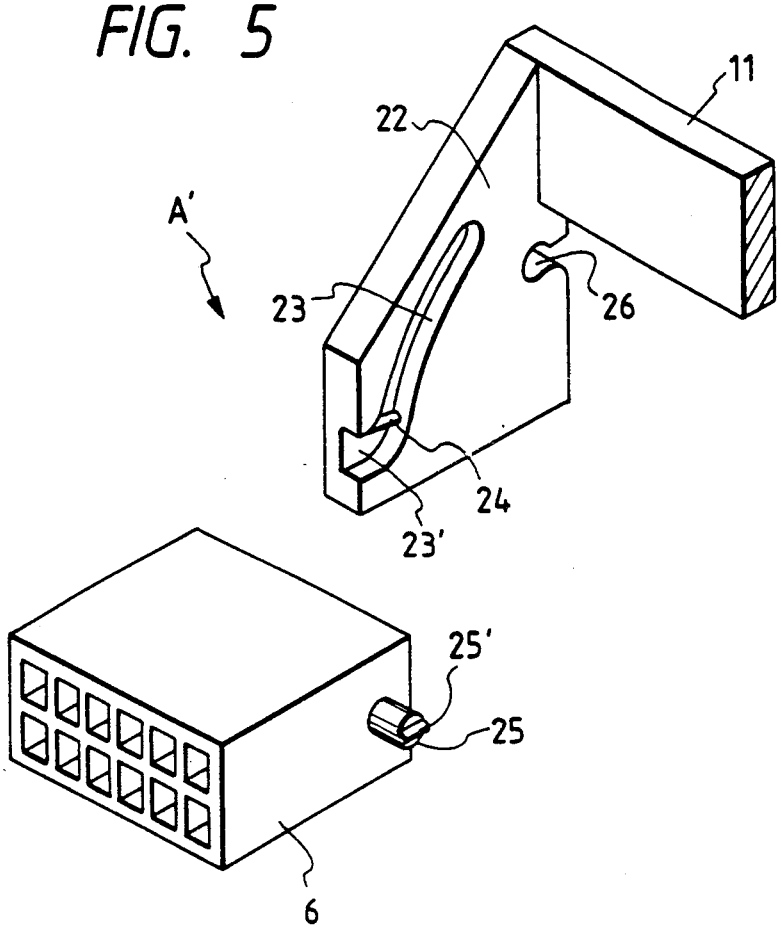
FIG. 5 is a fragmentary perspective view of a mechanism for preventing a lever type connector from being erroneously actuated according to a second embodiment of the present invention, particularly showing essential components for the mechanism.

Next, FIG. 5 is a fragmentary perspective view of a lever type connector A' including a mechanism for preventing the lever type connector A' from being erroneously actuated according to a second embodiment of the present invention, particularly showing essential components for the lever type connector A' in the disassembled state.

Cam levers 22 on the connector housing side are connected to each other via an actuating plate 11 extending therebetween, and eccentric cam grooves 23 each having a bottom wall are formed on the cam levers 22. Each eccentric cam groove 23 has a horizontal groove portion 23', and a provisional engagement portion 24 contoured in the form of an engagement projection is formed at the rear end of the horizontal groove portion 23' while extending in the horizontal direction. On the other hand, a pair of pins 25 projecting outside of both the side walls 8 of a male connector 6, and a provisional engagement receiving potion 25' contoured in the form of an engagement projection is projected from each pin 25 so that it is located opposite to the provisional engagement portion 24. In FIG. 5, reference numeral 26 designates an insert hole for pivotally holding a cam shaft 12.

Other structure rather than the aforementioned one is same to that in the first embodiment of the present invention. Thus, repeated description will not be required.

Figure 6:
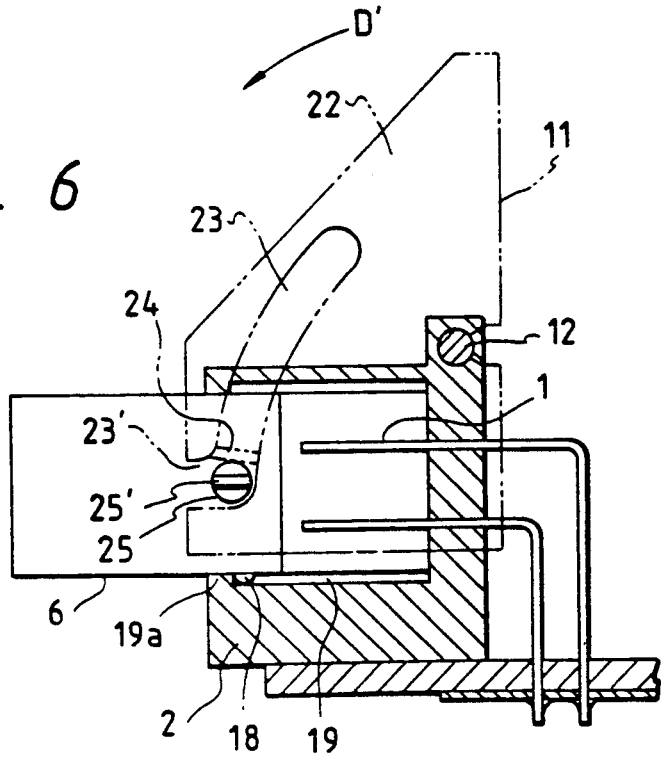
FIG. 6 is a vertical sectional side view of the mechanism shown in FIG. 5, particularly showing that components for the mechanisms are held in the half fitted state.
Figure 7:
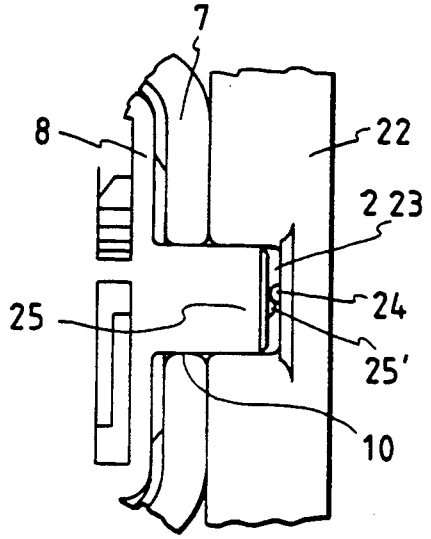
FIG. 7 is an enlarged fragmentary sectional plan view of the mechanism, particularly showing that the components for the mechanism are held in the half fitted state.
Figure 8:
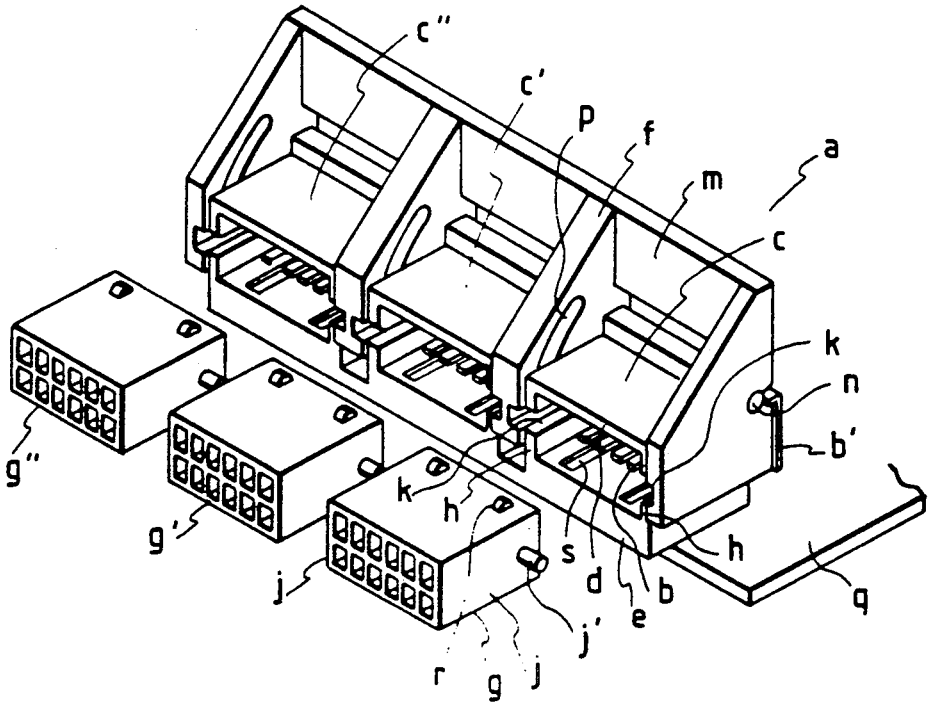
FIG. 8 is a perspective view of a conventional lever type connector.
Figure 9A:
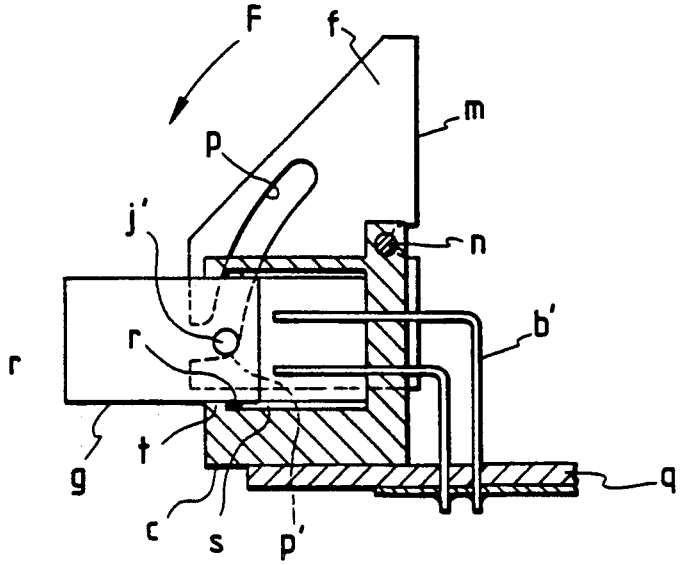
FIG. 9(A) is a fragmentary vertical sectional side view of the lever type connector shown in FIG. 8, particularly showing that components for the connector are held in the half fitted state.
Figure 9B:
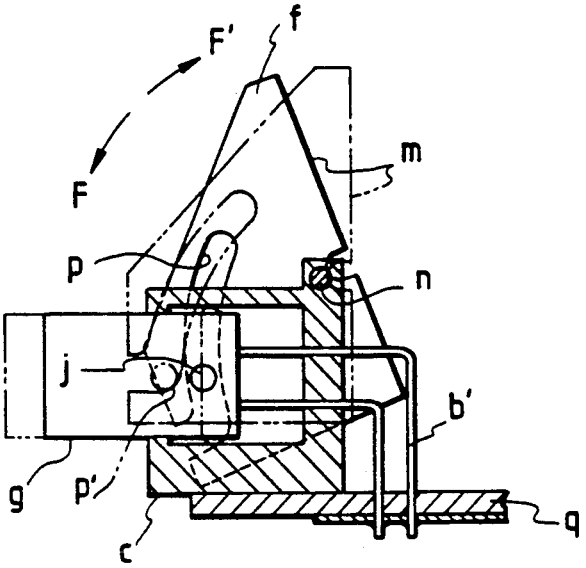
FIG. 9 (B) is a fragmentary vertical sectional side view of the connector, particularly showing that the connector is erroneously actuated.
FIG. 9(C) is a fragmentary vertical sectional view of the mechanism, particularly showing that a male connector is fully fitted into a connector housing.
Figure 9C:
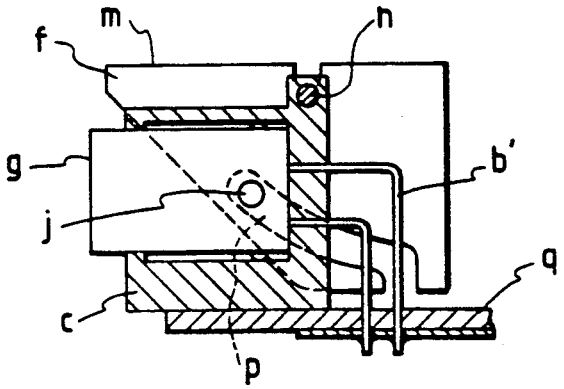

Since the mechanism for preventing a lever type connector from being erroneously actuated is constructed according to the second embodiment of the present invention in the above-described manner, when the female connector 6 is inserted into a female connector housing to assume a half fitted state as shown in FIG. 6, the provisional engagement portion 25' on the pin 25 projecting outside of the male connector 6 collides against the lower side of the provisional engagement portion 24 of the horizontal groove portion 23' on the eccentric cam groove 23 (see FIG. 7). At this time, an operator senses that the male connector 6' is firmly held in the half fitted state in such a manner that the provisional engagement portion 25' abuts against the upright standing wall of the eccentric cam groove 23 at the rear end of the horizontal groove portion 23'.

In addition, at this time, the provisional engagement portion 25' on the pin 25 is engaged with the provisional engagement receiving portion 24 of the eccentric cam groove 23 to assume a provisionally engaged state. Thus, the cam lever 22 is reliably maintained in the initial state further unless a certain magnitude of turning force in excess of a predetermined value is imparted to the cam lever 22 (see FIG. 7).

Subsequently, when the cam lever 22 is turned in the D' arrow-marked direction in FIG. 6 after a male connector 6' is inserted into a female connector housing 2' to assume a half fitted state, the provisional engagement portion 24 in the horizontal groove 23' climbs the provisional engagement receiving portion 25' of the pin 25, causing the provisionally engaged state to be canceled.

Subsequently, each eccentric cam groove 23 slidably moves along the pin 25 on the male connector 6 so that the pin 25 is displaced in the fitting direction, whereby the male connectors 6 and 6' are reliably fitted into the female connector housings 2 and 2' at the same time.

Therefore, since there is no possibility that the cam lever 22 is erroneously turned unless an exterior force having a magnitude in excess of the predetermined value is imparted to the cam lever 22 in the D' arrow-marked direction, there does not arise a necessity for retracting the cam lever 22 to the initial state with an operator's hand every time a connector fitting operation is performed. For this reason, each connector fitting operation can be achieved at a high efficiency.

According to the first and second embodiments of the present invention, the cam lever is arranged on the female connector housing side. However, the present invention should not be limited only to this. Alternatively, it is also acceptable that the cam lever is arranged on the male connector side.

The present invention has been described above with respect to a lever type connector usable with a low intensity of inserting/drawing force for connecting wire harnesses to each other or connecting a wire harness to an electric device or instrument wherein a provisional engaging portion is formed in the region where an provisional engaging portion on a male connector starts to be inserted into an eccentric cam groove formed on a cam lever arranged on the female connector housing side groove in order to prevent the cam lever from being erroneously actuated when the male connector is inserted into the female connector housing to assume to a half fitted state. Consequently, the present invention has provided a mechanism for preventing a lever type connector from being erroneously actuated wherein the mechanism assures that each connector fitting operation can be achieved smoothly.

What is claimed is:

1. A connector comprising:

a plurality of connector housings successively joined to each other, each of said connector housings having a slot portion in a side wall thereof;

a plurality of connectors respectively insertable into said connector housings, each of said connectors being provided with a pin protruding from a side wall thereof and being inserted into a corresponding slot portion of said connector housings;

a plurality of cam levers corresponding to said connector housings and respectively rotatably supported by opposite wide wall surfaces of said connector housings so as to rotate about a cam shaft, each of said cam levers having a cam groove, including an opening portion, on a side surface thereof for slidably receiving an associated pin of an associated connector, said connectors being moveable from a provisionally engaged position to a completely engaged position by rotating said cam levers from a first position, at which said opening portions are respectively aligned with said slot portion to receive said pins, to a second position; and means for preventing said cam levers from rotating from said first position when said connectors are respectively inserted into said connector housings so as to be located at said provisionally engaged position at which said pins are respectively urged against an abutting point on a surface defining said cam grooves.

2. The connector as claimed in claim 1, wherein each of said cam levers are integral to each other.

3. A connector as claimed in claim 1, wherein said rotating preventing means comprises:

a provisional engagement member disposed at said abutting point on said surface of each of said cam grooves, and an auxiliary provisional engagement member formed on said pins of said connector, said auxiliary provisional engagement member being engaged with said provisional engagement member when said cam lever is located at said first position.

4. A connector as claimed in claim 3, wherein said provisional engagement member includes a projection and said auxiliary provisional engagement member includes one of a projection and a groove.

* * * * *